US005664406A

United States Patent [19]

Smith

[11] Patent Number: 5,664,406

[45] Date of Patent: Sep. 9, 1997

[54] BAG ZIPPER ACTUATOR

[75] Inventor: Steven Lew Smith, Buford, Ga.

[73] Assignee: United Parcel Service of America, Inc., Atlanta, Ga.

[21] Appl. No.: 610,277

[22] Filed: Mar. 4, 1996

[51] Int. Cl.[6] ..... B65B 7/02; B65B 43/26; B65B 67/04; B65B 67/12

[52] U.S. Cl. ..... 53/459; 53/468; 53/469; 53/284.7; 53/570; 53/384.1; 53/390

[58] Field of Search ..... 53/459, 468, 469, 53/284.7, 570, 384.1, 390, 373.6, 374.8

[56] References Cited

U.S. PATENT DOCUMENTS

| | | | |
|---|---|---|---|
| 3,190,049 | 6/1965 | Van Der Meulen | 53/570 X |
| 3,568,402 | 3/1971 | Lense et al. | 53/570 X |
| 3,945,173 | 3/1976 | Buzzi | 53/284.7 X |
| 4,124,966 | 11/1978 | Wilson | 53/284.7 X |
| 4,249,361 | 2/1981 | Tetenborg et al. | 53/469 X |
| 4,291,517 | 9/1981 | Lipes | 53/469 X |
| 4,423,583 | 1/1984 | Carey | 53/384.1 X |
| 4,586,319 | 5/1986 | Ausnit | 53/384.1 X |
| 4,665,552 | 5/1987 | Lems et al. | 53/469 X |
| 4,744,196 | 5/1988 | Gallo | 53/390 X |
| 4,848,064 | 7/1989 | Lems et al. | 53/469 X |
| 5,177,939 | 1/1993 | Lipes | 53/284.7 X |
| 5,179,816 | 1/1993 | Wojnicki | 53/384.1 X |
| 5,394,674 | 3/1995 | Peppard et al. | 53/284.7 X |
| 5,398,484 | 3/1995 | Kader | 53/284.7 X |
| 5,514,962 | 5/1996 | Ausnit | 53/469 X |

*Primary Examiner*—Horace M. Culver
*Attorney, Agent, or Firm*—Jones & Askew

[57] ABSTRACT

A method and apparatus is provided for providing a zippered bag in an open configuration to allow its filling with packages or other like items. The apparatus includes an automatic bag zipping feature, and is resettable by depression of a foot pedal by an operator. The bag is maintained in its "open" position by a pair of flaps, which when open tend to hold the bag mouth open, but when closed no longer interfere with the bag mouth, such that a pull arm can pull the bag mouth into a closed position, and a zip arm can zip the mouth closed. The zip and pull arms are transported by a weight falling under the influence of gravity, which can be reset manually by an operator.

15 Claims, 8 Drawing Sheets

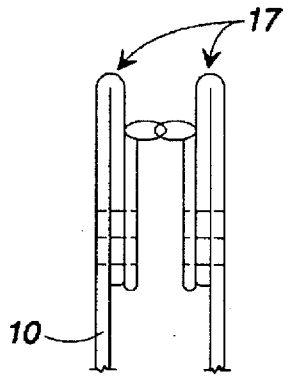
FIG. 9A
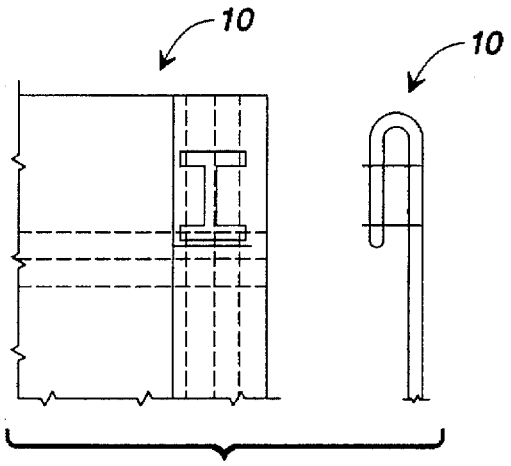
FIG. 9B
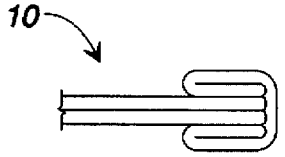
FIG. 9C
FIG. 9D
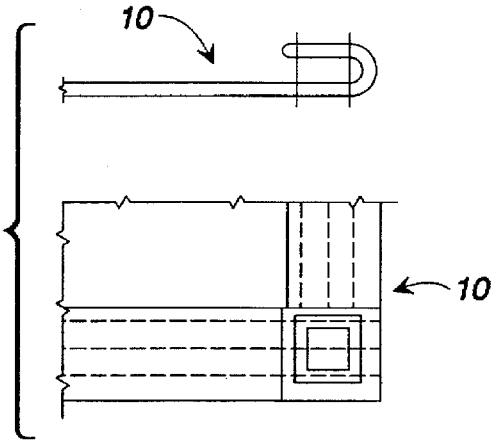
FIG. 9E
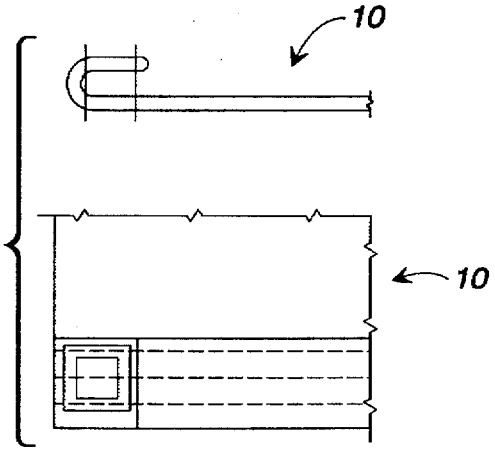

BAG ZIPPER ACTUATOR

TECHNICAL FIELD

This invention relates in general to package handling, particularly relates to the use of a zippered bag to contain selected groups of packages or other items, and more particularly relates to a method and apparatus for providing such a bag in an open position configured to accept packages therein, and for also "automatically" closing the bag in a closed position. In one preferred embodiment, such automatic closing is provided by a weight which is reset by a human operator.

BACKGROUND OF THE INVENTION

In the prior art, it is generally known to provide empty bags at a location for filling with a product, with the bags being closed after filling. For example, U.S. Pat. No. 4,249,361 to Totenburg, entitled "Method and Apparatus for Automatically Filling and Closing Large Sacks", disclosed an apparatus for automatically filling large sacks which includes a device for closing a filled sack by folding the sides of the sack adjacent its opening in a zig-zag pattern to form a "frill", which is secured by tape. In U.S. Pat. No. 5,394,674 to Peppard, entitled "Packaging Machine and Method", an apparatus is disclosed which includes the use of serially-connected preopened bags, which are sequentially transferred to and spread open at a loading station, prior to sealing by means such as heat.

In two related patents, U.S. Pat. Nos. 4,848,064 and 4,665,552 to Lems, disclosure is made of a method and apparatus for filling and closing reclosable zippers on bags such as used in the food industry, by the use of a pair of cooperating stationary pinch rolls.

U.S. Pat. No. 5,177,939 to Lipes, entitled "Bagging Machine with Bag Holding Transfer and Stretch Means" discloses a method and apparatus for stretching plastic bags such that a heat-sealing clamp can provide a wrinkle-free seam along the stretched length of the seam.

Although the prior art described above includes advantages, it nevertheless fails to accomplish or in some instances even address situations in which a low cost, high speed zipper bag closing mechanism is needed, such as is the case in the package handling environment. The prior art is likewise lacking in the provision of apparatuses which can accomplish such desired results, but require only the manual energy of a single operator to operate.

SUMMARY OF THE INVENTION

The present invention overcomes deficiencies in the prior art by providing a low cost, high speed zipper bag closing mechanism, which is powered by gravity via a falling weight and is manually reset by a foot operated pedal. Such a machine could be used in conjunction with a separate machine which automatically sorts to this bag and which can give a signal for the bag to be closed and released into a material handling system. An operator would then be notified (for example by a flashing light) to reset the machine according to the invention and to place a new bag in the bag holder. This operator could service several bag stations.

Generally described, the present invention relates to an apparatus comprising an apparatus frame means operably associated with the frame for holding said bag open to allow package loading through the bag mouth, means operably associated with the frame for closing the bag mouth after at least one package is inside the bag, and bag traversing and closing means operably associated but movable relative to the frame for traversing the mouth of the bag from its first to its second end while the bag is supported by said frame, such that the mouth of the bag is at least partially closed and such that the package is contained within the bag.

The present invention also relates to a method of filling a reclosable bag having an elongate zippered mouth having a first and a second end and a traversable zip mechanism for opening and closing said bag, the method comprising the steps of: supporting the bag such that the mouth of the bag is directed generally upwardly and is open sufficient to introduce packages therein, the support being provided at first and second locations proximate the first and second mouth ends and the support also being provided at least one location intermediate the first and second ends for maintaining the bag mouth in the open state, placing at least one package within the bag through the open mouth, withdrawing said intermediate support of the bag mouth.

moving the first and second mouth ends outwardly such that the zippered bag opening tends to close, and finally, urging the zip head along a path such that the mouth is at least partially closed and said package is contained within the bag.

Therefore, it is an object of the present invention to provide an improved method and apparatus for handling packages.

It is a further object of the present invention to provide an improved method and apparatus for handling packages which is simple in construction and operation.

It is a further object of the present invention to provide an improved method and apparatus for handling packages which is cost-efficient in construction and operation.

It is a further object of the present invention to provide an improved method and apparatus for handling packages which is labor-efficient in construction and operation.

It is a further object of the present invention to provide an improved method and apparatus for handling packages which is reliable in construction and operation.

It is a further object of the present invention to provide a method and apparatus for handling a bag configured for accepting packages therein.

It is a further object of the present invention to provide a method and apparatus for automatically closing a bag having packages therein.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

FIG. 9A is a detailed view of a portion of the bag 10 shown in FIG. 8, particularly showing stitch locations. It should be understood that the stitch type used may be FST 401(3), 9 stitches per inch, plus or minus 1 stitch per inch.

FIG. 9B is a detailed view of a portion of the bag 10 shown in FIG. 8, particularly showing stitch locations, which may be of type 304 lockstitch bartack (2), with 28 stitches per bartack.

FIG. 9C is a detailed view of a portion of bag 10 of FIG. 8, showing stitches which may be of type FST 401(3).

FIG. 9D is a detailed view of a portion of bag 10 of FIG. 8, showing stitch locations in its side and top view sections which may be of stitch type 304 lockstitch bartack (2), with 28 stitches per bartack.

FIG. 9E is a detailed view of a portion of the bag 10 shown in FIG. 8, with stitching being similar to that shown in FIG. 9D in both its side view and top view sections.

DETAILED DESCRIPTION OF THE PREFERRED EMBODIMENT

Reference is now made to the drawings, in which like numerals designate like elements throughout the several views.

Overview

A general overview of the construction and operation of the apparatus and method according to the present invention will now be made, with general reference to the figures.

Figure 1:
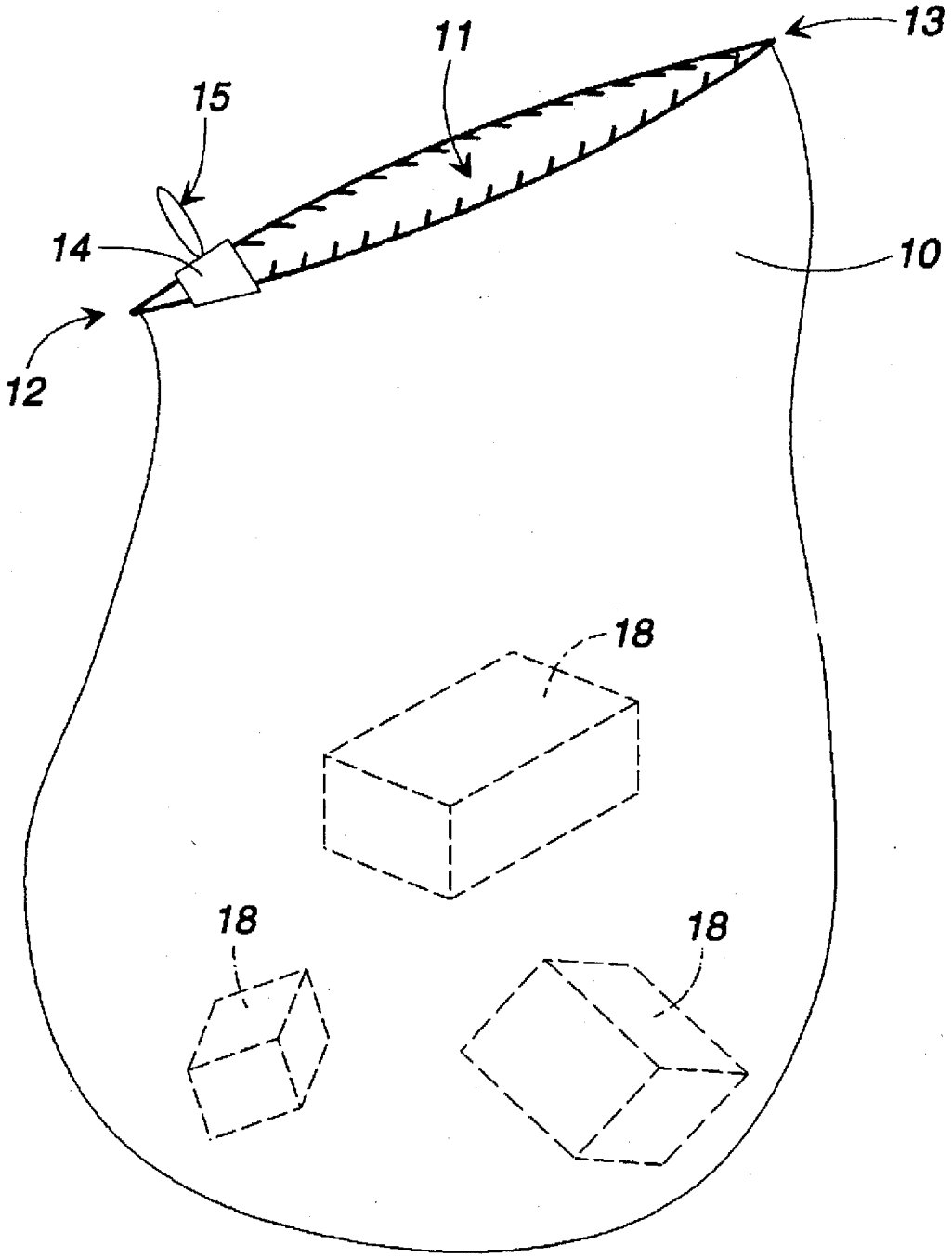
FIG. 1 is an isolated view of a flexible bag according to the present invention.

With reference to FIG. 1, the invention contemplates use of a zippered flexible bag 10 including a zippered opening 11 at one end. By moving a conventional zip element 14 (also known as a "zip head") from the front end 12 of the elongate opening to the rear end 13 of the elongate opening, the opening or "mouth" of the bag may be selectively closed, thus retaining packages 18 or other elements within the bag enclosure. This "closing" feature is one feature provided under the present invention.

Figure 2:
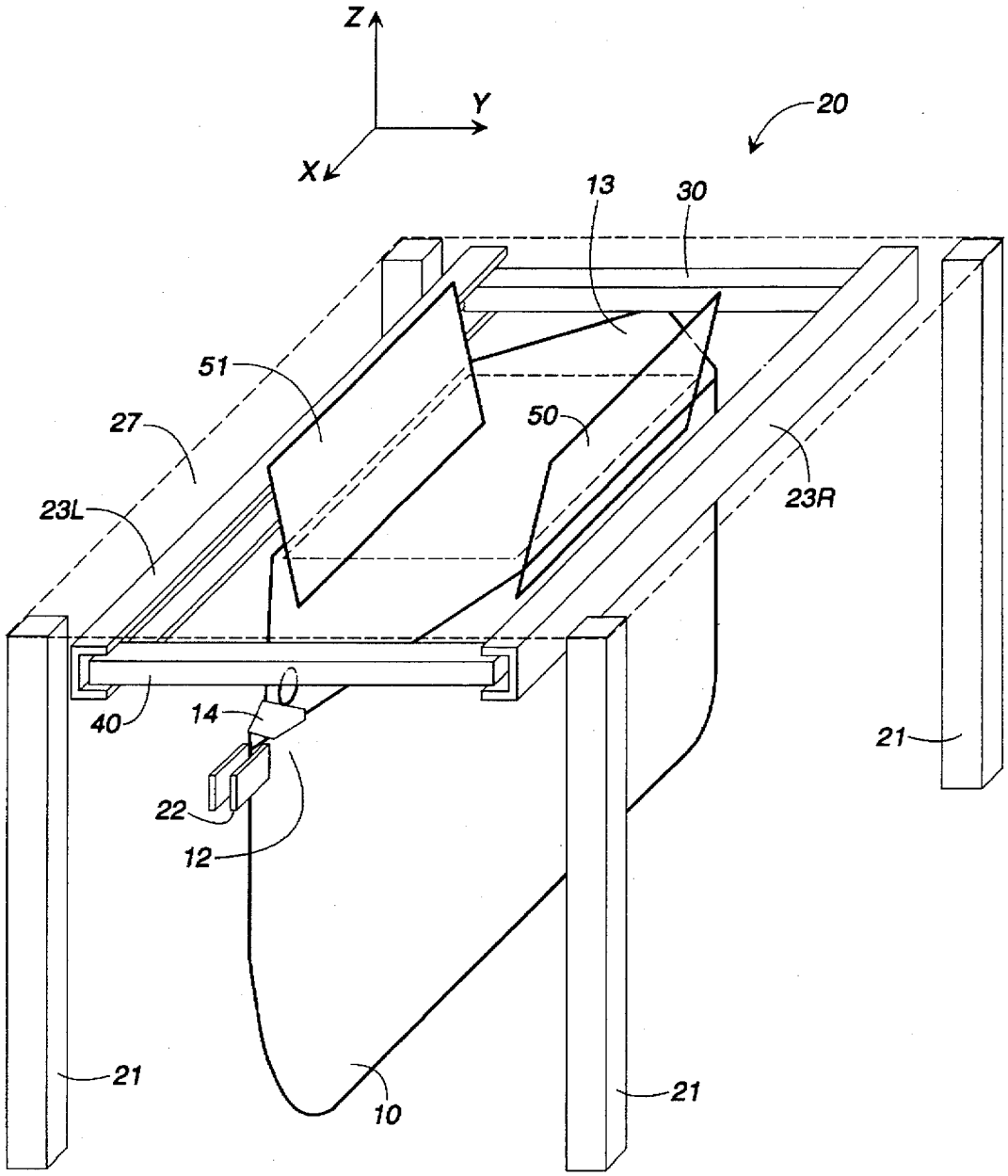
FIG. 2 is an isometric, partially illustrative view of a flexible bag according to the present invention. This view illustrates a top supporting table in phantom, and illustratively shows the use of guide channels.

As shown in FIG. 2, the bag 10 is loaded onto the apparatus 20 while a pair of pivoting flaps 50, 51, are in their "open" positions as shown. The pivoting flaps extend partly into the mouth of the bag, and maintain the mouth in its shown "open" position, while the front (or "first") end 12 of the bag is releasably suspended from a stationary clamp 22 (mounted relative to the apparatus frame), and the rear (or "second") end 13 of the bag is also suspended by a moving clamp configuration attached relative to a pull arm 30.

Figure 3:
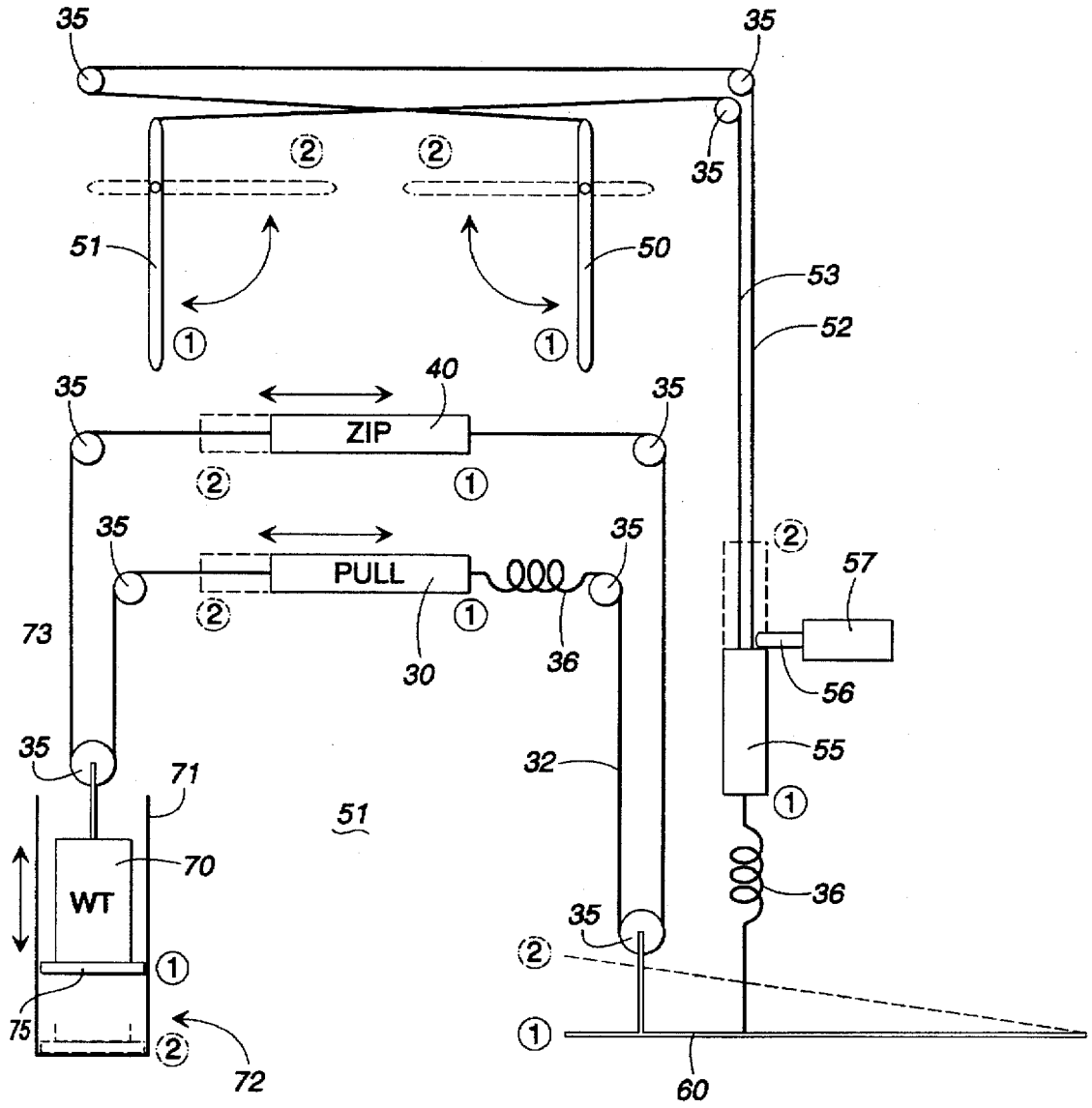
FIG. 3 is an illustrative view of cable/pulley routing according to the present invention.

Basic operation of the apparatus is as follows. The bag 10 is loaded relative to the apparatus as shown in FIG. 2. Packages such as 18 (see FIG. 1) are then dropped into the mouth of the bag 10. When the bag 10 is suitably filled, a solenoid is energized, which begins the "automatic bag closing" feature of the invention. Referring now also to FIG. 3, the solenoid 57 moves a retaining latch 56, which allows a flap retaining tube 55 to move upwardly, allowing spring-loaded right and left flaps 50, 51, to move toward their spring-loaded closed positions as shown in dotted line in FIG. 3. At this point the flaps are no longer in the mouth of the bag, and a pull arm 30 is then allowed to pull the rear end 13 of the bag further away from the front end 14 to substantially close (but not yet zip shut) the mouth of the bag. A zip arm 40 is then allowed to move rearwardly towards the rear edge of the bag mouth. As the zip element 14 is attached to and held by the zip arm 40, this causes the mouth of the bag 10 to be at least partially zipped closed. Towards the end of the "zipping" movement, the apparatus then releases the bag at all three of its attachment points to allow it to drop from the apparatus 20. The apparatus 20 is then in its "BAG DISCHARGED" position. By stepping upon a reset pedal 60, the apparatus can then be manually reset by an operator, such that another bag 10 can be mounted on the apparatus to accept new packages such as 18.

The Parts

With reference to FIG. 1, the invention contemplates use of a zippered flexible bag 10 including a zippered opening 11 at one end. By moving a conventional zip element 14 from the first end 12 of the elongate opening to the second end 13 of the elongate opening, the opening or "mouth" of the bag may be selectively closed, retaining packages 18 or other elements within the bag enclosure. The zip element 14 of the bag (also known as a "zip head") includes an engagement loop 15.

Figure 8:
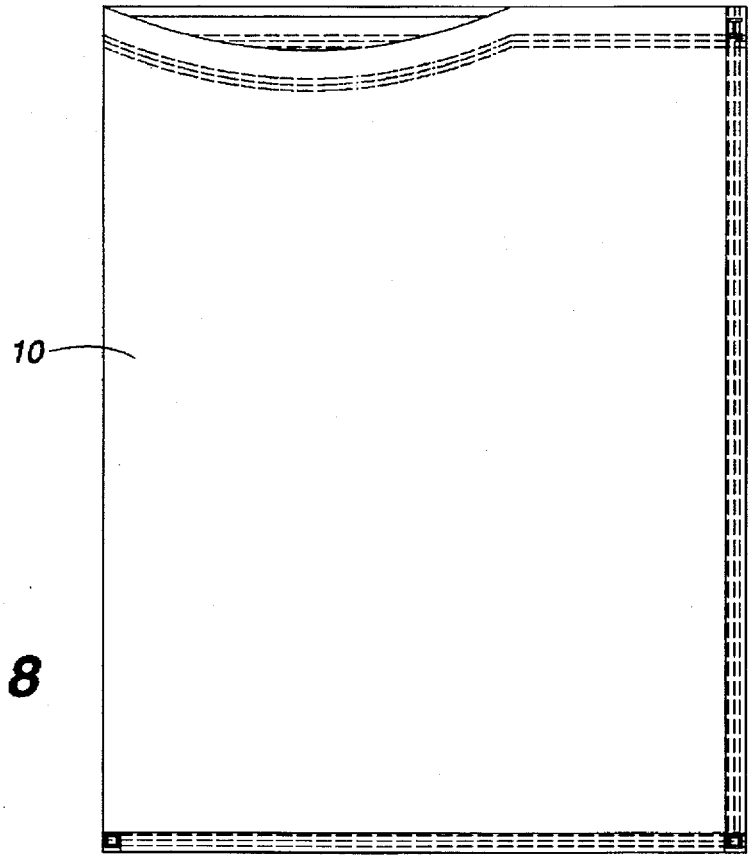
FIG. 8 is a plan view of a bag 10 used as part of the present invention.

Reference is now made to FIG. 8, which is a side plan view of a bag 10 according to the present invention. This drawing can be referenced in conjunction with FIGS. 9A–9E.

As may be seen, this bag (in one embodiment) is formed from a single piece of flexible fabric such as woven monofilament nylon, such as manufactured by YKK, Inc., style 9CF single sided chain ¾" 580, which is folded in half and sewn into a bag by providing a closed seam along the lower and one side edge, and by providing a zippered opening at the top, which as shown in FIG. 9A includes two similar seams intermediate the zipper and the bag fabric. As will be discussed later in further detail, the bag 10 is grasped and supported by means of a stationary clamp 22 which grasps the seams from the outside, and also by means of a movable hook 37 which extends partially within the bag 10, and engages the seams 17 from inside and underneath.

Referring now to FIG. 2, the apparatus 20, having frame members generally designated as 21, is shown supporting a bag 10 with its mouth directed generally upwardly and open. The apparatus 20 includes right and left pivoting flaps 50, 51, pivotably mounted relative to an upper supporting table 23 (shown in phantom). These substantially planar right and left pivoting flaps 50 are each spring mounted to close from their open positions shown in FIG. 2, to closed, substantially vertical positions (not shown in FIG. 2).

Figure 6:
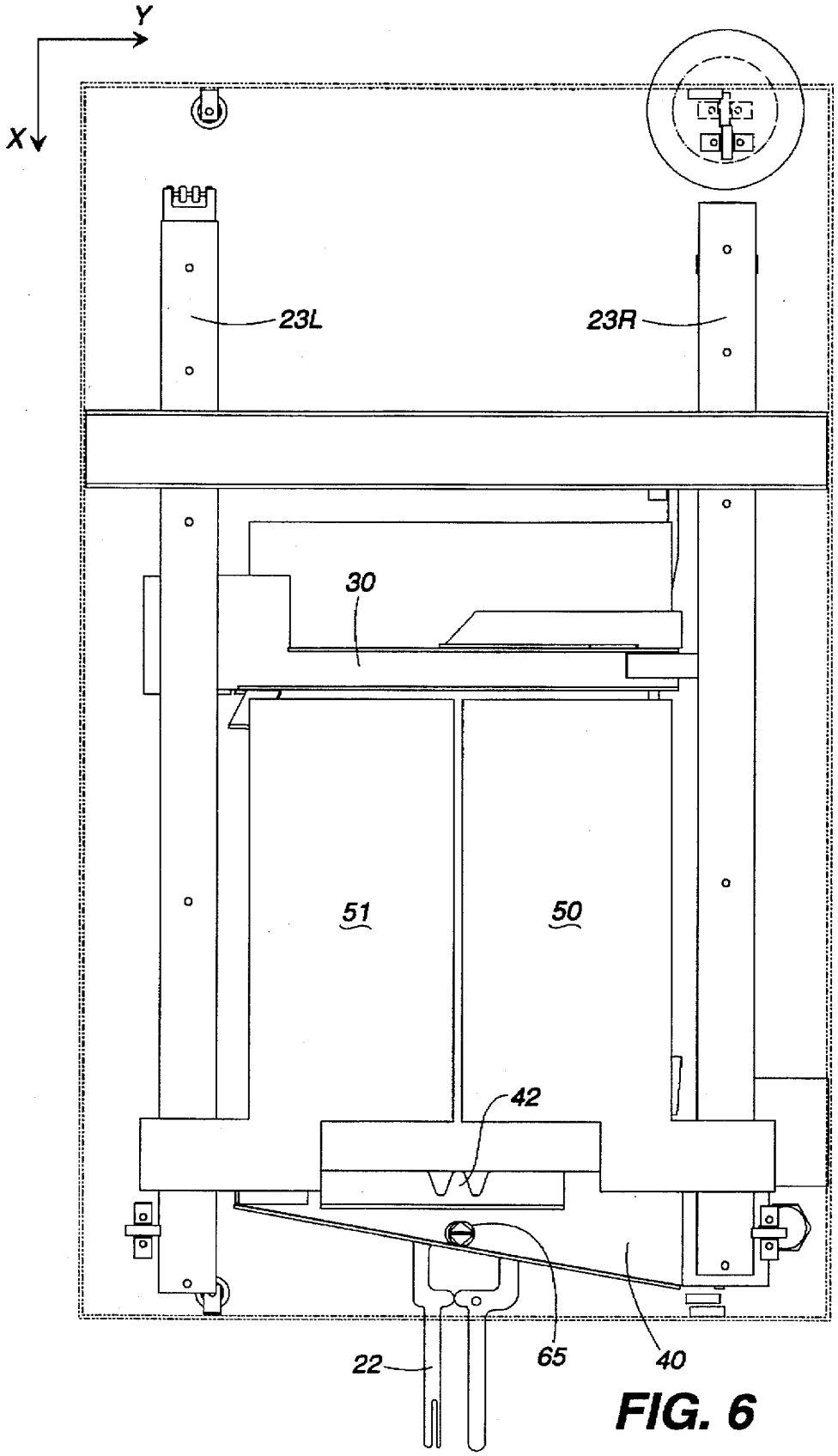
FIG. 6 is a top view, computer-aided line drawing of an apparatus according to the present invention.

The apparatus 20 also includes a pull arm 30 and a zip arm 40. Both the pull arm 30 and the zip arm 40 are slidably mounted relative to the frame of the apparatus 20 by means of a pair of elongate, substantially parallel, cofacing guide channels generally designated as 23L, 23R. Although the guide channels are 23L, 23R of FIG. 2 illustratively shown to each consist of a single channel, in the preferred embodiment shown in FIG. 6 are configured as follows.

The open channels face each other and are mounted under the top supporting table 27. Under each channel 23L, 23R, is mounted a ball bearing slide. The right end of the zip arm 40 is attached to the slide which is driven by a cable as discussed later. The left end of the zip arm has a plastic glide which is inserted into the opening of the left channel 23L and slides therein.

Figure 7:
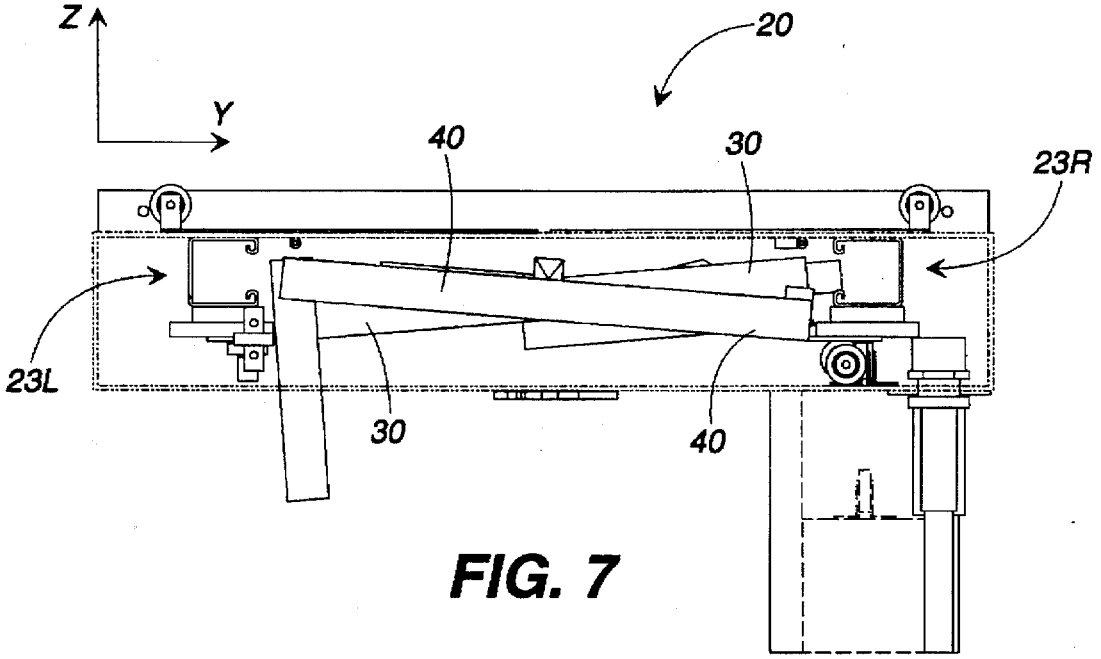
FIG. 7 is a side view, computer-aided line drawing of an apparatus according to the present invention.

The left end of the pull arm is attached to the ball bearing slide which is mounted under the left channel. The right end of the pull arm has a plastic glide which moves inside the right channel (23R). Therefore, it can be seen that the somewhat elongate arms 30, 40, each extend across and bridge the two channels 23L, 23R, in a slightly "criss-cross" manner shown in FIG. 7.

The drive cables are attached to the ball bearing slides which move in the X direction. These slides resist motion in the Z and Y directions and moments around X, Y and Z. The plastic glides support loads in the Z direction only which represents approximately half of the weight on the arm. Such a feature reduces complexity, cost and manufacturing tolerances.

Referring now also to FIG. 3, the interconnection of various elements of the apparatus is now discussed. This drawing illustrates various elements of the apparatus in either a Position "#1" (reset pedal down), or a Position "#2" (reset pedal up).

A reset pedal 60 is shown, which is attached relative to a arm reset cable 32 by means of a typical pulley 35 rotatably mounted relative to the pedal 60. The arm reset cable 32 has one end attached to one side of the zip arm 40, and has another end attached (through an intermediate typical tension spring 36) to one end of the pull arm. As described in further detail, this allows the operator to "reset" the zip and pull arms 40, 30, respectively, to their reset (Position "1") positions by stepping on the reset pedal 60 which has its lowest end pivotably attached relative to the frame of the apparatus 20.

The apparatus 20 also includes a weight actuated cable 73, which has each of its ends attached to one of the pull and zip arms, such that tension on the weight actuated cable 73 tends to cause the zip and pull arms to move in a common direction towards their "#2" positions. Such tension is provided by means of a weight 70 disposed within a guide tube 71 having a vent opening 72. A typical pulley 35 is rotatably mounted relative to the upper end of the weight 70, and is configured to accept a middle portion of said weight actuated cable 73, such that the gravitational forces on the weight 70 tend to pull the zip and pull arms 40, 30, towards their "#2" positions.

The speed of the weight 70 as it falls may be limited by means of a damper disc 75 attached to the bottom of the weight 70, which provides a partial seal across the cross section of the guide tube. The vent opening 72 is positioned along the length of the guide tube to allow controlled air release out of the guide tube as the damper disc until the disc passes the vent opening, whereupon the vent opening is shunted and weight movement is further slowed. Such "pneumatic damping" has been found to be advantageous in that otherwise high speeds and resultant forces encountered by the zip and pull arms of the apparatus are avoided.

Again referring to FIG. 3, the movements of right and left pivoting flaps 50, 51, respectively, are controlled by corresponding right and left flap control cables 52, 53, respectively, each routed through a series of typical pulleys 35 to attach to an upper end of a movable flap retention tube 55. The flap retention tube 55 fits within a guide tube (not shown in FIG. 3), such that it can slidably move from its position #1 (flaps open) to position #2 (flaps closed). As the flaps are torsion spring loaded towards their closed (#2) positions, it may be understood that the torsion spring strength is sufficient to cause the flap retention tube to move from its position #1 to position #2. Such movement is allowed upon the disengagement of a tube retaining pin 56 which is retracted upon the energizement of a conventional solenoid 57.

The lower end of the flap retention tube 55 is attached relative to the reset pedal by means of a conventional tension spring 36. As described in detail later, when the reset pedal is depressed, this spring is strong enough to cause the flap retention tube 55 to be drawn downwardly (overcoming the flap torsion spring forces), allowing the upper end of the flap retention tube 55 to be drawn beneath and consequently retained by the spring biased tube retaining pin 56, after the pedal is released.

The Method

The process may generally be understood to include the following three steps:

- bag mounting, in which the bag is mounted by an operator to the apparatus in its open position;
- bag filling, in which the bag receives packages from above into its open mouth; and
- bag ejecting, in which the bag is ejected from the apparatus in a closed state.

Bag Mounting

In the bag mounting step, the bag is mounted to the apparatus in its open position, with the aid of an operator. This step may be understood to include the following steps:

1. manually returning the apparatus from its "BAG DISCHARGED" to its "READY FOR BAG" position, by depression and release of the reset pedal; and
2. manually loading a bag onto the apparatus, such that the apparatus is in its "READY FOR PACKAGE LOADING" position. At this point, there is some slack in the bag mouth.

To execute the above-referenced Step 1, the operator simply pushes down on the reset pedal with his/her foot (not shown). As initially there is some "slack" between the flap retention tube and the pedal, this causes the first movement of the apparatus to be the movement of the pull and zip arms 30, 40 towards their reset or "#1" positions. It may be understood that the weight 70 is likewise moved up towards its "#1" position as the pedal is being depressed.

After the pull and zip arms 30, 40 are moved towards their reset or "#1" positions, the flaps 50, 51, are then allowed to pivot open towards their "#1" positions. It should be understood that the flaps 50, 51, are prevented from pivoting open until the pull and zip arm are in their "#1" positions by means of one or more stops operably associated with the pull and/or zip arm.

Figure 5:
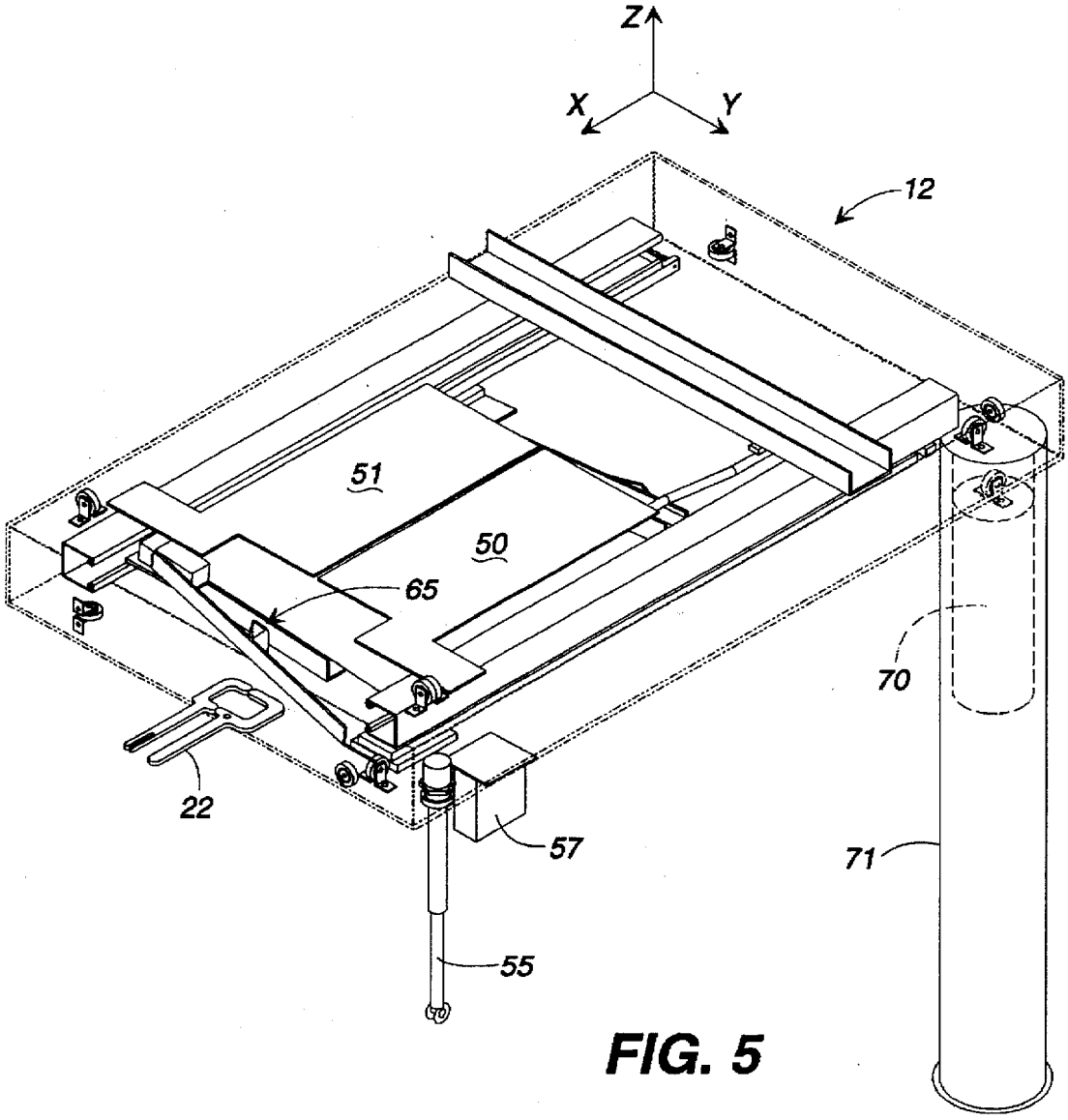
FIG. 5 is an isometric, computer-aided line drawing of an apparatus according to the present invention.

It should be understood that as the reset pedal is in the process of being pushed downwardly, the previous "slack" between the pedal and the flap retention tube is eventually taken up, and the intermediate tension spring is encountering increasing tension. This tension is transferred to the right and left flap control cables, eventually tending to urge the flaps towards their closed positions. However, the zip arm may not be out of the way yet. Therefore, a glide member 65 (see FIGS. 5 and 6) may be provided to allow for a sliding retention feature to allow the zip arm to be effective in sliding but retaining contact with the flaps above, until the zip arm (and the glide member) have moved out of the way to allow the flaps to open completely.

After the reset pedal 60 has been depressed (moving the zip arm, pull arm, and flaps to their "#1" positions), the pedal is then released. The zip and pull arms then tend to move back towards their "#2" positions (due to the pull of the weight), but stops provided on the now-open flaps block such movement, thus locking the zip arm in place until the flaps are closed. Thus the arm reset cable is slackened (assuming the reset pedal is released), while the weight cable remains in tension due to the lifted position of the weight 70.

The bag loading process ("Step 2" mentioned above) is now described. An open zippered bag is provided by the operator with its zip element 14 towards the open position, as shown in FIG. 1. Now also referring to FIG. 2, the pivot flaps may be understood to be pivoted into their open, that is, vertical positions, such that packages may be provided therethrough. The operator ensures that the rear end 13 of the cargo bag, opposite the zipper mechanism as it is then positioned, is attached relative to the pull arm 30 as described in detail later.

The operator then guides side wall portions of the bag proximate the opening about the open pivot flaps. The operator then engages the zipper ring 15 of the zip element 14 relative to the zip arm 40, by hooking the loop of the zipper ring onto a rearwardly-extending pawl 39 as described in detail later. The operator then secures the front end 12 of the bag, adjacent the zipper slider, by use of a stationary end clamp 22 having cooperating jaws opening away from the operator. The bag is now ready to be filled.

Bag Filling

Once the bag is positioned into its "loaded" position, it may be understood that it is configured to accept packages into its open mouth. Packages can be dropped through a chute and guided into the cargo bag opening by the pivoting flaps. When the bag is full, the present invention contemplates ejecting the cargo bag in a closed state. For purposes of this invention, this will be referred to the "Bag Ejecting" step.

Bag Ejecting

As discussed above, when the bag is full, it is then desirable to close it, and to eject it. Under the present invention, assuming the apparatus has been correctly "reset" and loaded, this can be done "automatically" responsive to a single control signal to the apparatus, namely a trigger-operating solenoid.

The closure sequence is generally as follows:

1. flaps close;
2. bag top is pulled straight;
3. zipper slider is pulled across bag;
4. bag pull keeper is released;
5. zipper loop is released; and
6. bag clamp is released.

In the inventor's experience to date, reset and reload time is typically about 4 seconds while zip close and release time is about 1 second.

Figure 4A:
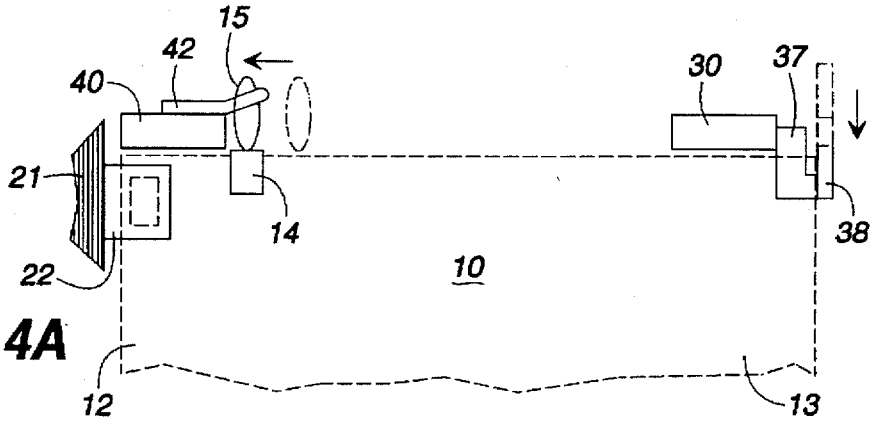
FIGS. 4A–4D illustrate various steps of mounting, closing, and discharging the flexible bag according to the present invention.
Figure 4B:
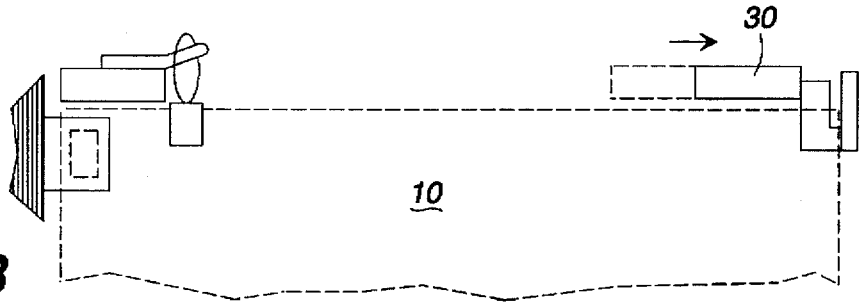
Figure 4C:
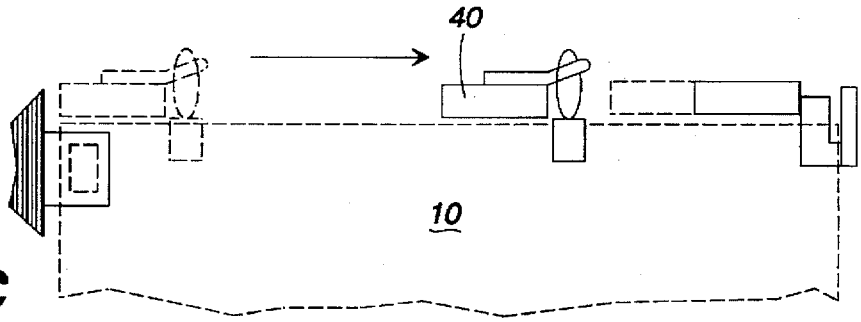
Figure 4D:
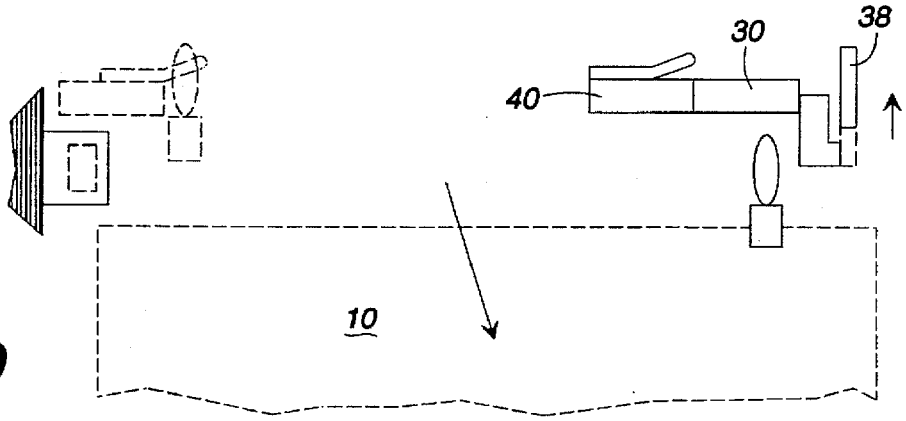

The automatic zip and release sequence begins when a "bag full" sensor, or a package count/volume calculation, indicates that the bag should be full. The sort controller wouldthen stop diverting packages into the bag and energize the trip release solenoid 57. The tube retaining pin 56 on the solenoid's plunger pulls away (right to left in FIG. 3) from the top of the flap retaining tube 55. The tube 55 is then pulled up by tension on the right and left flap opening cables 52, 53, which are attached to the right and left flaps 50, 51, respectively, which are spring loaded to close. The flaps 50, 51, which were down in the bag top, creating an approximately 12" opening, thus swing up and become substantially horizontal. The pull arm 30 is released by a right flap dog and under the force of the weight begins to pull the bag opening into a straight slot. The zip arm 40, which was released by a left flap cam, can now begin to pull the zipper element across the bag. When the zip arm 40 is about 1 inch away from the pull arm, three events begin to happen:

1. a zip ring pawl 42 (see FIGS. 4A–4D) starts to retract relative to the zip arm and drop the slider ring;
2. a keeper arm 38 is pivoted away from the bag pull hook 37 (see FIGS. 4A–4D, particularly FIG. 4D), and
3. a clamp release arm (attached the pull arm) is activated by the zip arm to pull a control cable which releases the trip lever on the stationary bag clamp 22.

At the end of these three events, the bag is no longer restrained by the bag zipper mechanism. The arms continue to move in the same direction until they hit their end stops. The drive weight has already hit a cushion stop on the bottom and rebounds to its rest position. The mechanism is now ready for reset and reload.

The damper disk acts as an air piston in the weight tube to reduce the acceleration and final velocity of the pull arm and zip arm. The drive weight damper disk and friction limit the speed of closure to about 30 inches per second at the end of stroke. This reduces the impact of moving parts and increases the system reliability. If uncontrolled, the final velocity could be four times higher and energy at impact would be sixteen times greater.

The zipper engaging and release mechanism includes a hook 42 which, in one position engages the zipper ring 15 mounted to a zip element 14 which, when caused to slide, will close the zipper. When the zip arm has traveled to the end of its slides and the zipper is closed, the zipper ring is caused to disengaged from the hook 42 by the release mechanism.

The zip and pull arms travel along slides supported by the frame, with slides being attached to one end of each of the zip and pull arms, and each of the zip and pull arms also having guide rollers being attached to the "other" end of each of the zip and pull arms.

Therefore, it may be seen that the present invention provides a method and apparatus for utilizing a zippered bag for package containment, which provides the bag in an open configuration suitable for containing packages therein, and also for "automatically" closing the bag as desired. Such automatic closing is provided under the present invention by the use of a manually resettable weight, which can be resent by a human operator, thus obviating the need for electrically—or pneumatically energized power sources.

Conclusion

While this invention has been described in specific detail with reference to the disclosed embodiments, it will be understood that many variations and modifications may be effected within the spirit and scope of the invention as described in the appended claims.

What is claimed is:

1. An apparatus for filling a bag with at least one package, said bag having a substantially elongate reclosable mouth having a first mouth end and a second mouth end, said apparatus itself comprising:

an apparatus frame;

means operably associated with said frame for holding said bag open to allow package loading through said bag mouth;

means operably associated with said frame for closing said bag mouth after at least one package is inside said bag; and bag mouth traversing and closing means operably associated but movable relative to said frame for traversing said mouth of said bag from its first to its second end along a path substantially parallel to said elongate reclosable mouth while said bag is supported by said frame, such that said mouth of said bag is at least partially closed and such that said package is contained within said bag.

2. The apparatus as claimed in claim 1, wherein said apparatus further comprises at least one flap pivotable relative to said frame of said apparatus between an first and a second position, said flap configured while in said first position to assist said apparatus in holding said bag mouth open during package loading, and further configured while in said second position to be free of interference with said bag mouth traversing and closing means during the closing of said bag mouth.

3. An apparatus for filling a bag with at least one package, said bag having a substantially elongate reclosable zippered mouth having a first mouth end and a second mouth end and including a zip head mechanism, said apparatus itself comprising;

an apparatus frame;

bag support means for at least partially supporting the weight of said bag;

bag mouth holding means operably associated with said frame for holding said bag open to allow package loading through said bag mouth;

means operably associated with said frame for closing said bag mouth after at least one package is inside said bag; and zip head transport means operably associated but movable relative to said frame for releasably engaging and transporting said zip head along a first direction such that said zip head traverses said mouth of said bag from its first end and towards its second end, and consequently at least partially closing said zippered mouth of said bag such that said package is contained within said bag.

4. The apparatus as claimed in claim 3, wherein said bag mouth holding means of said apparatus comprises at least one flap pivotable relative to said frame of said apparatus between a first and a second position, said flap configured while in said first position to assist said apparatus in holding said bag mouth open during package loading, and further configured while in said second position to be free of interference with said zip head transport means during the closing of said bag mouth.

5. The apparatus as claimed in claim 4, wherein said bag support means comprises first and second bag grasping means, said first bag grasping means configured for grasping said bag at a first location proximate said first mouth end, and said second bag grasping means configured for grasping said bag at a second location proximate said second mouth end.

6. The apparatus as claimed in claim 5, wherein said second bag grasping means itself comprises:

a hook at least partially extending inside said bag mouth; and a pull arm supporting said hook, said pull arm configured to traverse a path substantially parallel to the longitudinal axis of said elongate mouth of said bag.

7. The apparatus as claimed in claim 5, wherein said zip head transport means itself comprises:

a pawl extending generally in said first direction; and a zip arm supporting said pawl, said pull arm configured to traverse a path substantially parallel to the longitudinal axis of said elongate mouth of said bag, said path generally being directed in said first direction.

8. The apparatus as claimed in claim 3, wherein said bag support means comprises first and second bag grasping means, said first bag grasping means configured for grasping said bag at a first location proximate said first mouth end, and said second bag grasping means configured for grasping said bag at a second location proximate said second mouth end.

9. The apparatus as claimed in claim 3, wherein said second bag grasping means itself comprises:

a hook at least partially extending inside said bag mouth; and a pull arm supporting said hook, said pull arm configured to traverse a path substantially parallel to the longitudinal axis of said elongate mouth of said bag.

10. The apparatus as claimed in claim 9, further comprising a weight element and at least one tension cable intermediate said pull arm and said weight, wherein said pull arm is transportable by means of said weight moving from a higher to a lower position, and said weight element being manually "reset" to said higher position by an operator.

11. The apparatus as claimed in claim 3, wherein said zip head transport means itself comprises:

a pawl extending generally in said first direction and configured to releasably engage said zip head mechanism; and a zip arm supporting said pawl, said pull arm configured to traverse a path substantially parallel to said longitudinal axis of said elongate mouth of said bag, said path generally being directed in said first direction.

12. The apparatus as claimed in claim 11, further comprising a weight element and at least one tension cable intermediate said zip arm and said weight, wherein said zip arm is transportable by means of said weight moving from a higher to a lower position, and said weight element being manually "reset" to said higher position by an operator.

13. The apparatus as claimed in claim 3, wherein said flap is spring loaded to said second position.

14. The apparatus as claimed in claim 3, wherein said flap provides guidance for packages introduced into said mouth of said bag.

15. A method of filling a reclosable bag having an elongate zippered mouth having a first and a second end and a traversable zip mechanism for opening and closing said bag, said method comprising the steps of:

supporting said bag such that said mouth of said bag is directed generally upwardly and is open sufficient to introduce packages therein, said support being provided at first and second locations proximate said first and second mouth ends, and said support also being provided at least one location intermediate said first and second ends for maintaining said bag mouth in said open state;

placing at least one package within said bag through said open mouth;

withdrawing said intermediate support of said bag mouth;

moving said first and second mouth ends outwardly such that said zippered bag opening tends to close; and urging said zip mechanism along a path substantially parallel to said elongate zippered mouth while said bag is substantially stationary such that said mouth is at least partially closed and said package is contained within said bag.

* * * * *